United States Patent [19]

Zeigler

[11] Patent Number: 4,970,841

[45] Date of Patent: Nov. 20, 1990

[54] UNIVERSAL BUILDING SYSTEM

[75] Inventor: Theodore R. Zeigler, Washington, D.C.

[73] Assignee: Nomadic Structures, Inc., Springfield, Va.

[21] Appl. No.: 742,842

[22] Filed: Jun. 10, 1985

[51] Int. Cl.[5] ..... E04H 12/18

[52] U.S. Cl. ..... 52/646; 52/655; 160/135; 24/625

[58] Field of Search ..... 52/646, 648, 109, 645, 52/DIG. 10, 655; 403/171; 160/135, 351, 352, 353, 381; 40/610; 24/625

[56] References Cited

U.S. PATENT DOCUMENTS

| | | | |
|---|---|---|---|
| 3,577,608 | 3/1971 | Texler | 24/625 X |
| 3,968,808 | 7/1976 | Zeigler | 52/109 X |
| 4,178,736 | 12/1979 | Sulas | 52/655 X |
| 4,276,726 | 7/1981 | Derus | 52/646 X |
| 4,437,275 | 3/1984 | Zeigler | 52/109 |
| 4,471,548 | 9/1984 | Goudie | 52/109 X |
| 4,512,097 | 4/1985 | Zeigler | 40/610 X |
| 4,522,008 | 6/1985 | Zeigler | 52/646 |

FOREIGN PATENT DOCUMENTS

| | | | |
|---|---|---|---|
| 2611622 | 9/1977 | Fed. Rep. of Germany . | |
| 2262770 | 9/1975 | France | 403/171 |

*Primary Examiner*—Carl D. Friedman

*Attorney, Agent, or Firm*—Merchant, Gould, Smith, Edell, Welter & Schmidt

[57] ABSTRACT

A system of construction comprising a plurality of modules. The modules have a plurality of struts and pivots joining the struts so that they are moveable between a collapsed condition in which the struts are bundled in generally parallel relation and an expanded condition. In the expanded condition certain of the pivots define face pivots lying in a planar array at one side of the module. The modules are arranged such that pairs of the face pivots of adjacent modules are adjacent to each other. The adjacent face pivots are joined by removable connectors. The connectors join the modules to form a three dimensional structure and simultaneously define corner recesses. At least one panel is held in place by a plurality of the corner recesses.

65 Claims, 10 Drawing Sheets

FIG. 1
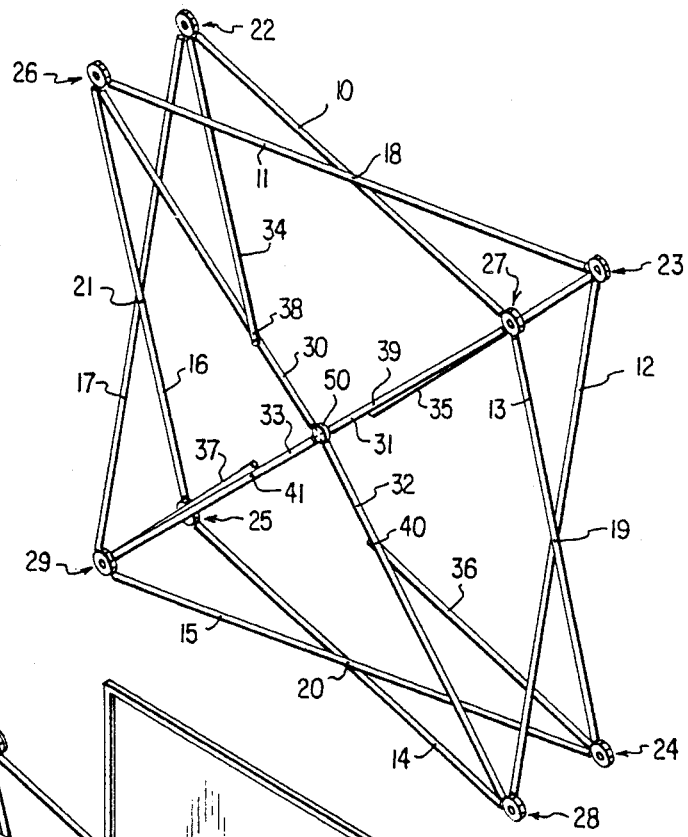
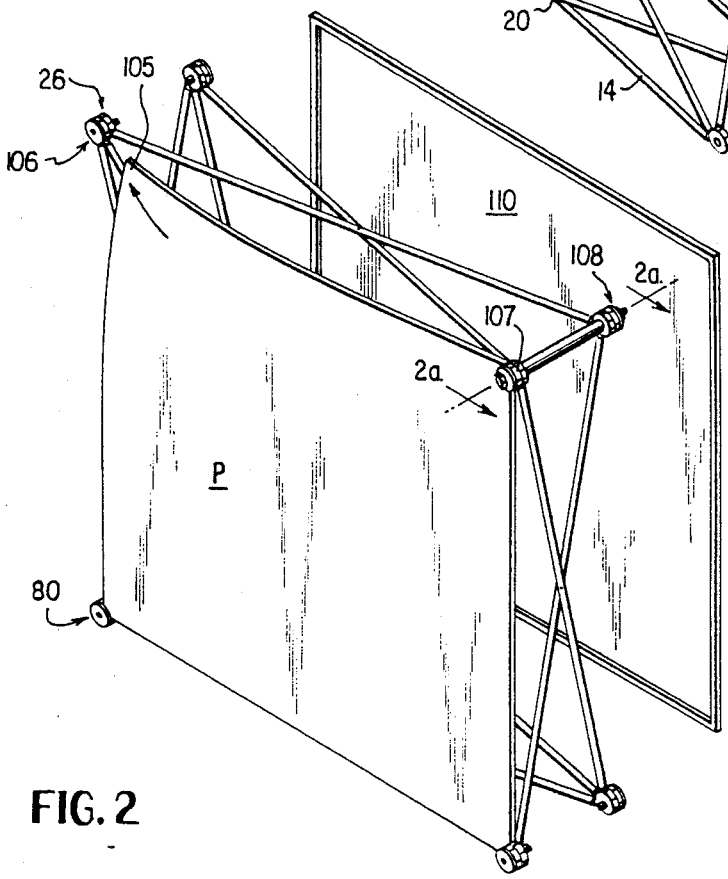
FIG. 2

FIG. 3
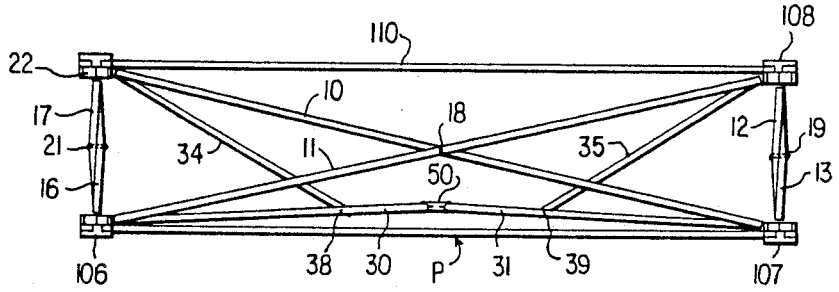
FIG. 4
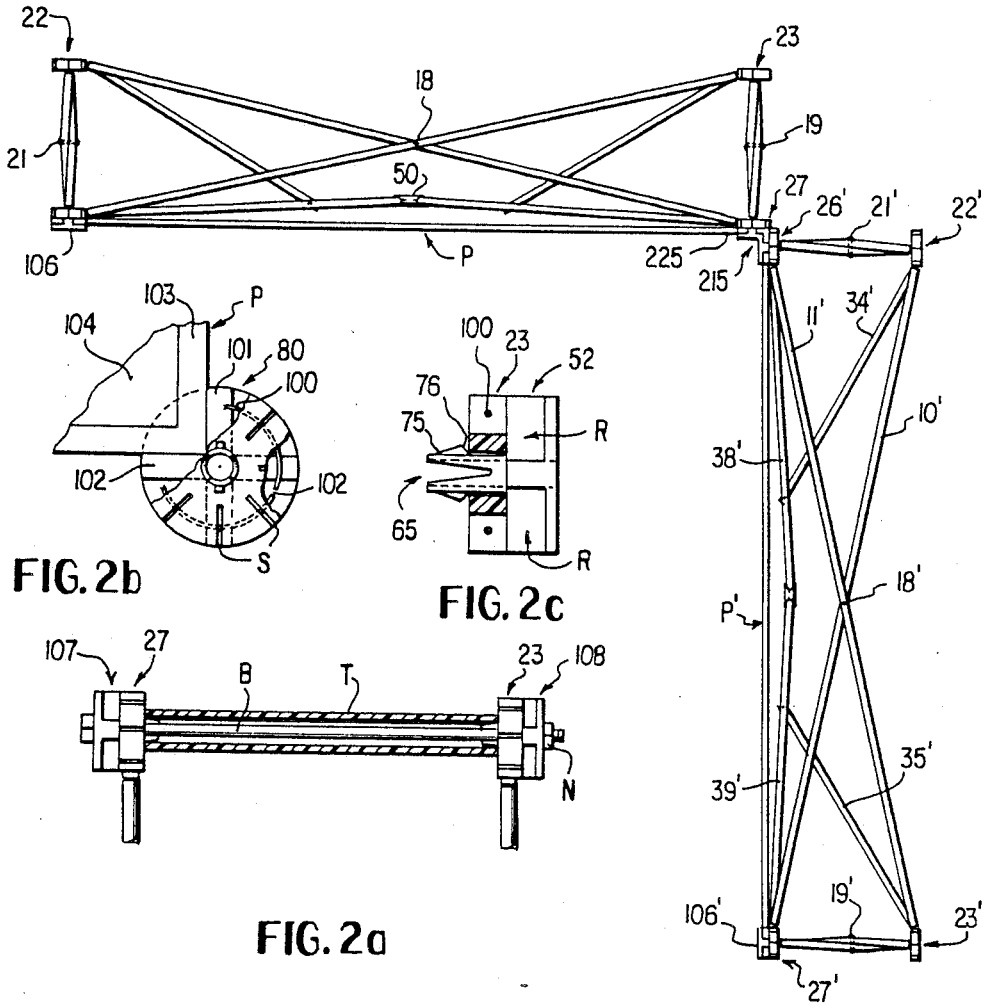
FIG. 2b
FIG. 2c
FIG. 2a

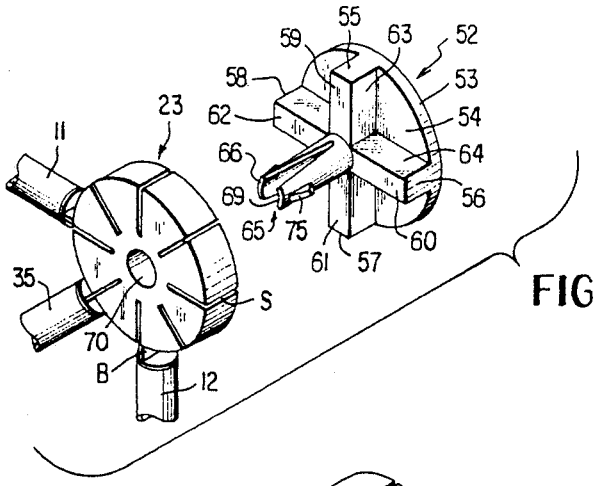
FIG. 21
FIG. 21a
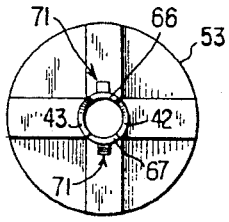
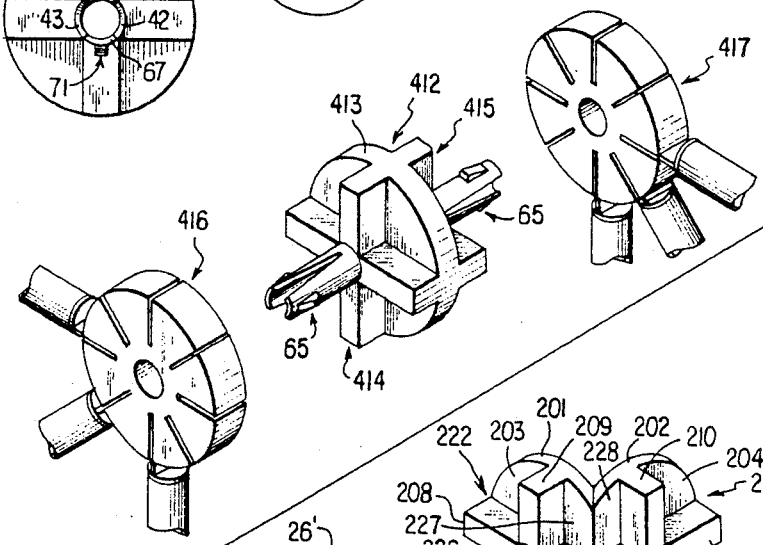
FIG. 22
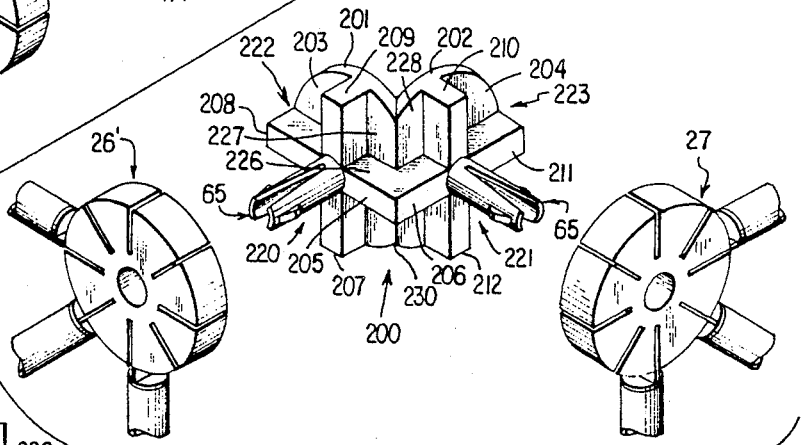
FIG. 23
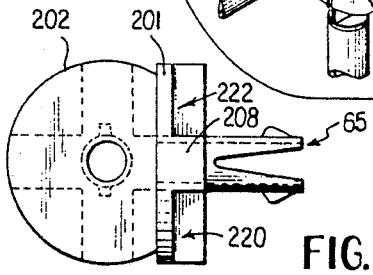
FIG. 23a FIG. 24
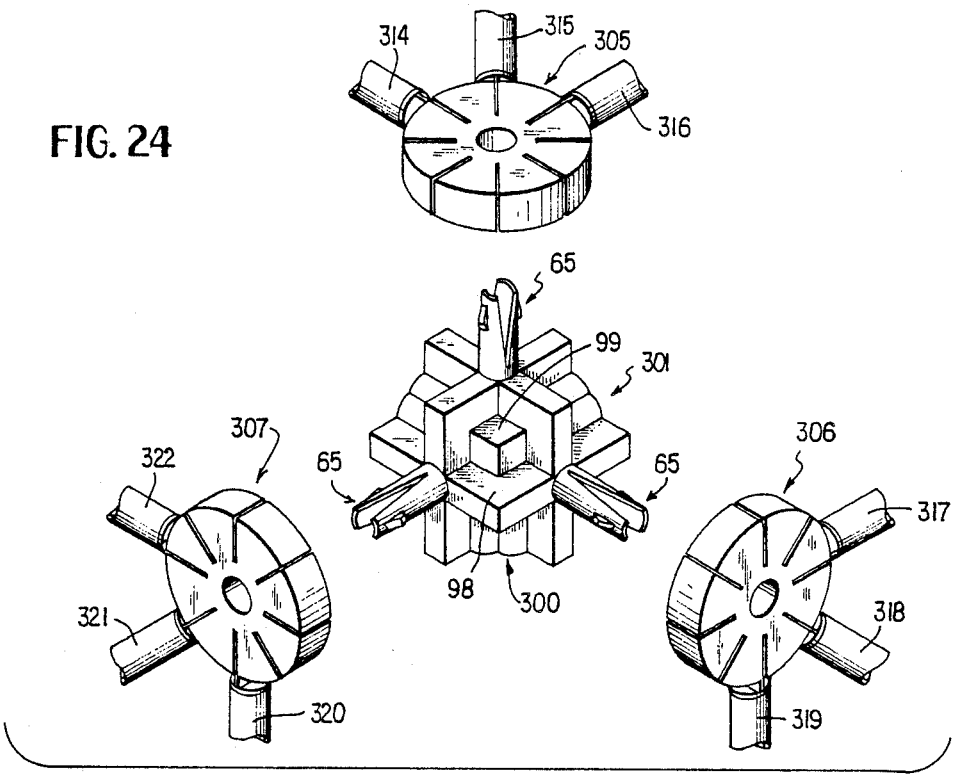
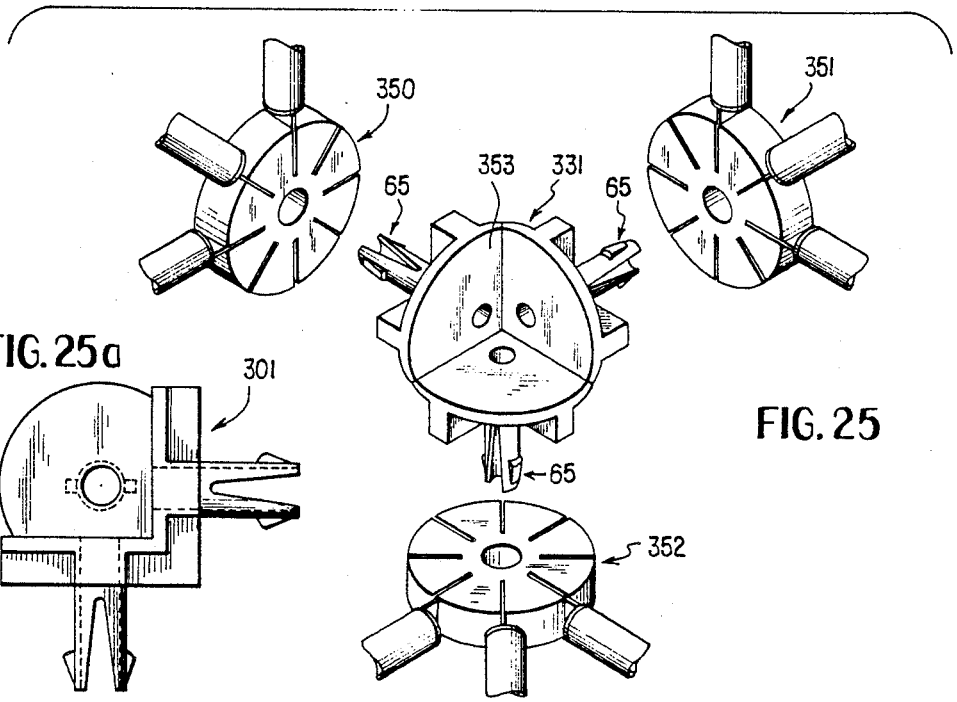
FIG. 25a
FIG. 25

UNIVERSAL BUILDING SYSTEM

CROSS REFERENCE TO RELATED APPLICATION

This application is related to my prior application Ser. No. 409,435, filed Aug. 19, 1982 which issued as U.S. Pat. No. 4,522,008 on June 11, 1985, the subject matter of which is incorporated herein by reference thereto.

BACKGROUND OF THE INVENTION

This invention concerns a composite space frame assembly which employs an arrangement of expandable/collapsible modules which may be self-locking or self-supporting when expanded or they may be of the type which employs manual locking in the expanded condition. The modules may conform to the subject matter of my prior U.S. Pat. Nos. 3,968,808; 4,026,313; 4,280,521; 4,290,244; 4,437,275; and 4,473,986 or to that of Derus RE 31,641. The modules may also be of the type disclosed in my copending application Ser. No. 656,937, filed Oct. 2, 1984, the subject matter of which is incorporated herein by reference thereto, and which is a continuation-in-part of my prior U.S. Pat. No. 4,473,986, the subject matter of which is also incorporated herein by reference thereto.

BRIEF SUMMARY OF THE INVENTION

The invention is intended primarily for commercial or industrial exhibits, particularly those used at an exhibition wherein each manufacturer or subscriber is allotted a particular space or stall. In such exhibitions, it is of particular importance that the structural framework and accounterments be capable of rapid setup and knockdown. The structural framework and in general the assembly comprising the basic exhibit structure must be pleasing to the eye, it must afford sufficient surface area upon which graphics depicting the products exhibited, explanations and information relative to such products may be displayed and, in general, any such information or instructions which may be relevant to the purpose of the exhibits. Basic modules and frame structures as are set forth and defined in the aforesaid patents are particularly suited for this purpose. However, the present invention is directed to a modification of such systems which allows a wide variety of exhibits to be constructed rapidly and in an efficient manner.

Basically, the present invention is directed to a module which is of three dimensional structure or form in which the module comprises a plurality of struts and pivot means pivotally joining the struts together so that the struts may be manipulated between a collapsed condition in which the struts are in generally parallel relation in a compact bundle and an expanded condition in which the struts define a three dimensional form having certain of the pivot means defining a rectangular planar array thereof. Corner recesses are provided at each of the stated rectangular planar array of pivot means and a removable rectangular panel is provided which has means received and held captive within the corner recesses. The panel, or panels, may serve as pleasing background appearance and/or for providing a suitable graphic display.

In another basic aspect, the present invention Is directed to a composite space frame structure comprising a plurality of three dimensional modules which are arranged relative to each other to define a three axis composite space frame structure which may be extended in the direction of each axis by module addition. In such a composite space frame structure, means are provided for detachably connecting the modules along adjacent or touching edges thereof in accord with the three axis configuration and these means simultaneously provide corner recesses for removably receiving corresponding panels. In this way, the configuration may provide opposite side faces for each module which are covered by corresponding panels. Thus, although the underlying framework is of space frame configuration, the panels not only provide decoration and/or graphic representation but they also lend a solid appearance to the entire structure. In this regard, flexible end panes may be utilized to cover the narrow sides of the modules or to join adjacent narrow sides of two modules to complete the solid appearance.

The modules may be self-supporting or self-locking when in the expanded condition, in accord with the aforesaid patents, in which case the panels are flexible and do not contribute in any significant way to the self-supporting aspect of each module. On the other, the modules may contain no intrinsic locking feature or they may be manually locked in the expanded condition. Particularly when the modules have no intrinsic locking feature, the panels may be sufficiently rigid as causes each module to be self-supporting when the panel is in place. This is particularly effective when two rigid panels are utilized on each module, one on each of the two larger faces or sides of the module.

In another aspect, the invention is directed to a three dimensional modular structure which includes a plurality of modules movable between a collapsed condition in which the struts thereof are bundled in generally parallel relation and an expanded condition in which certain of the pivot means inter-connecting the struts define face pivot means lying in a rectangular planar array at one side of the expanded module, and the modules being arranged in a pattern in which pairs of the face pivot means of adjacent modules are disposed in adjacent relation, connector means being removably received in such pairs of face pivot means of adjacent panels for joining the modules to form a three dimensional structure and simultaneously defining corner recesses with their associated face pivot means, the corner recesses being adapted to receive rectangular panels as stated above.

In another aspect, the invention is directed to a composite space frame structure fixed relative to three intersecting axes and to the origin defined by the point of intersection of such axes, the structure including a plurality of space frame modules and connector means for detachably connecting the modules in a fixed and spaced pattern relative to said origin and to the three axes such that all of the modules are equally spaced from the origin while one pair of two of the modules are equally spaced from all points along one of the three axes, another pair of two of the modules being equally spaced from all points along another of said three axes, and a further pair of two of the modules being equally spaced from all points lying along the last of the three axes. In such an assembly, it is preferred that each of the modules is of parallelepiped form and that the connector means define corner recesses with the respective modules to cooperate with panels having means for reception in such recesses. Preferably, again, each of the modules is constructed of a plurality of struts and is collapsible from its space frame con-figuration to a bundle of generally parallel struts. It is also preferred that each module includes circumscribing pairs of struts disposed in crossed relation and provided with pivot means for pivotally joining each such pair of struts in the crossed relation and wherein the module further includes strut means for self-locking the module in expanded, space frame configuration.

Another object of this invention is the provision of a structural framework comprising a plurality of modules and rigidifying elements which allow control over the distribution of forces within the framework. The rigidifying elements may be compression elements, they may be tension elements or they may be combined compression and tension elements. These elements may operate to relieve individual modules from forces which otherwise would distort, twist or otherwise deform the modules from their desired forms or would place the panels under stress or strain.

Other and further objects of this invention will be apparent from the following detailed description of the invention.

BRIEF DESCRIPTION OF THE DRAWING FIGURES

FIG. 1 is a perspective view of a preferred modular construction according to the present invention;

FIG. 2 is a view illustrating the module of FIG. 1 with a flexible panel being attached thereto and a further panel exploded from the opposite side of the panel;

Figure 5:
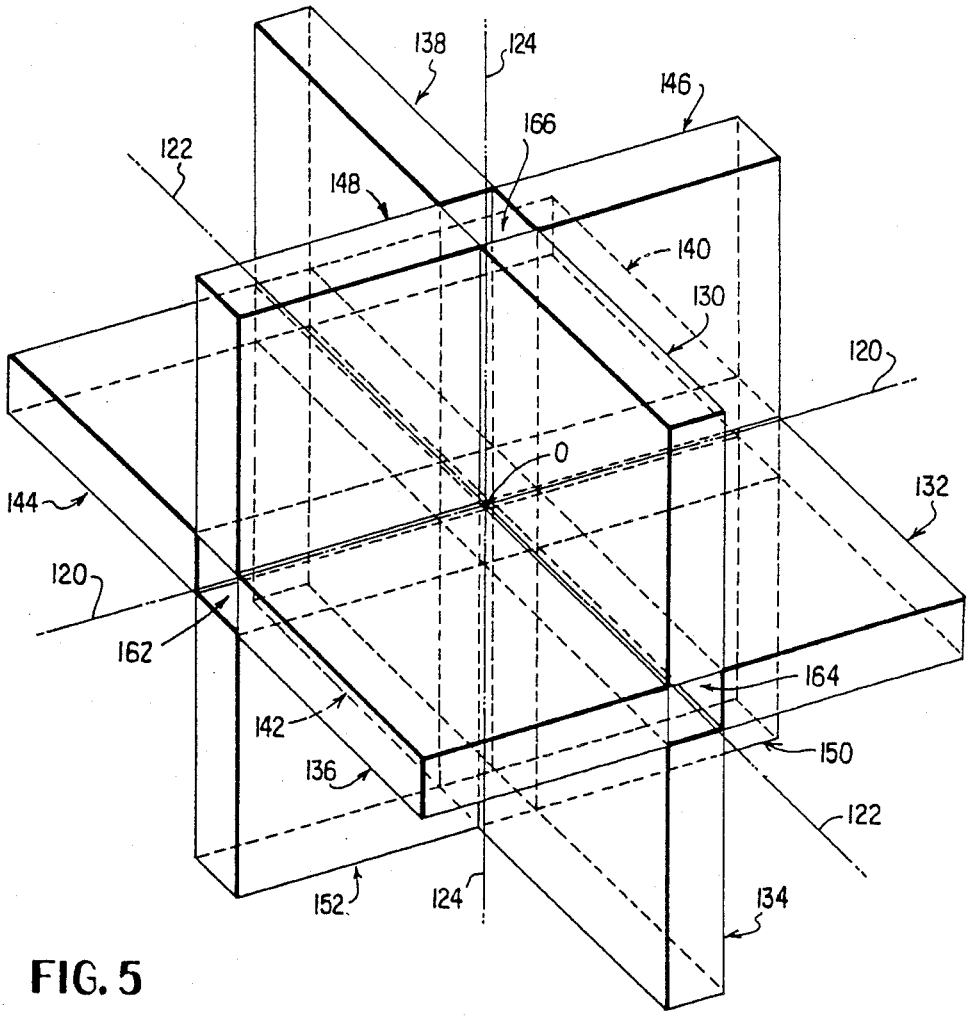
Figure 6:
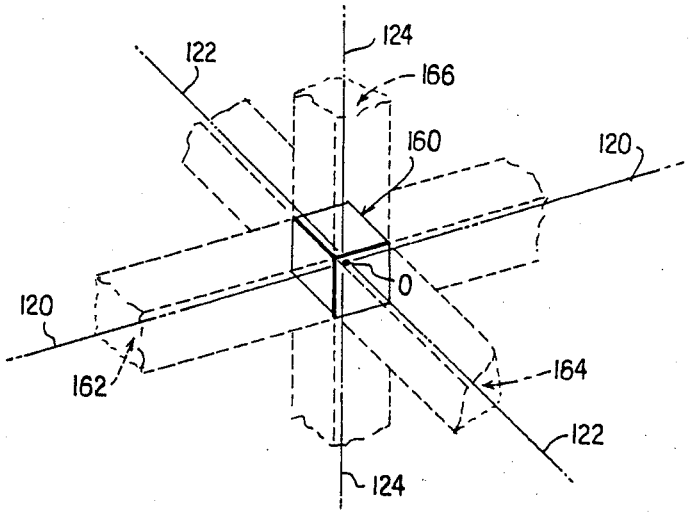
Figure 7:
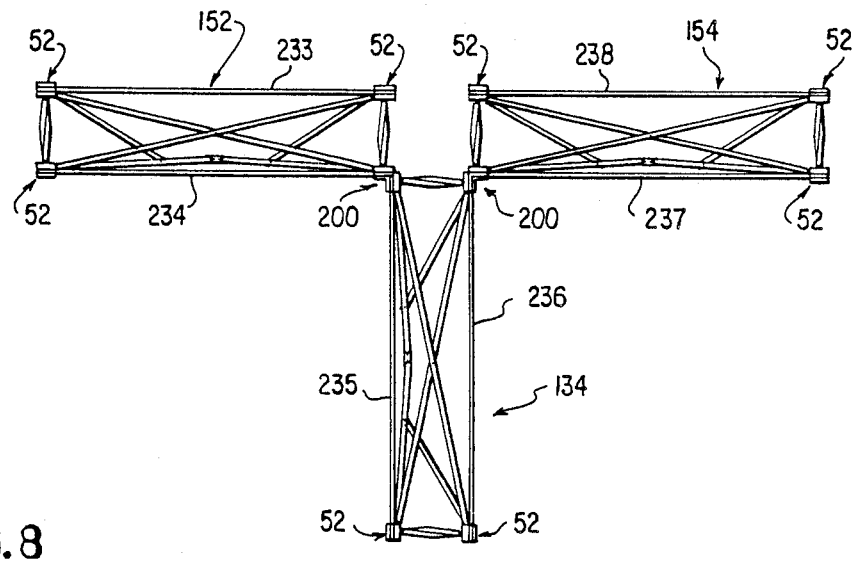
Figure 8:
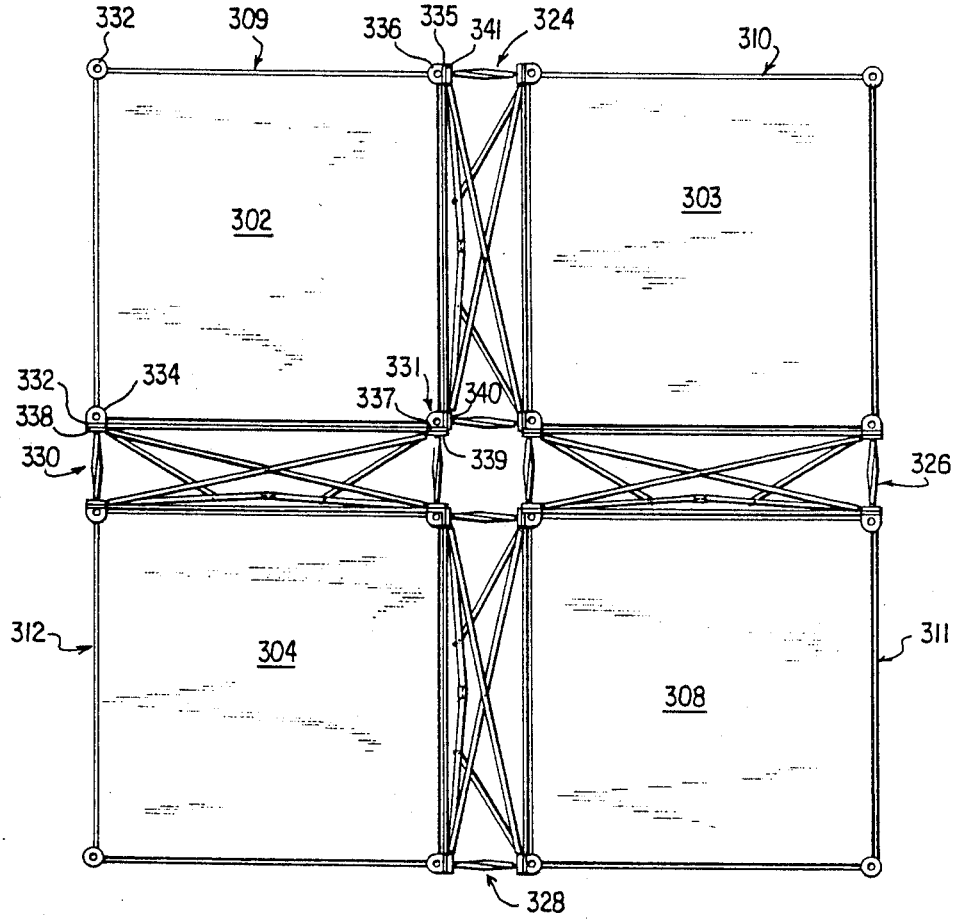
Figure 9:
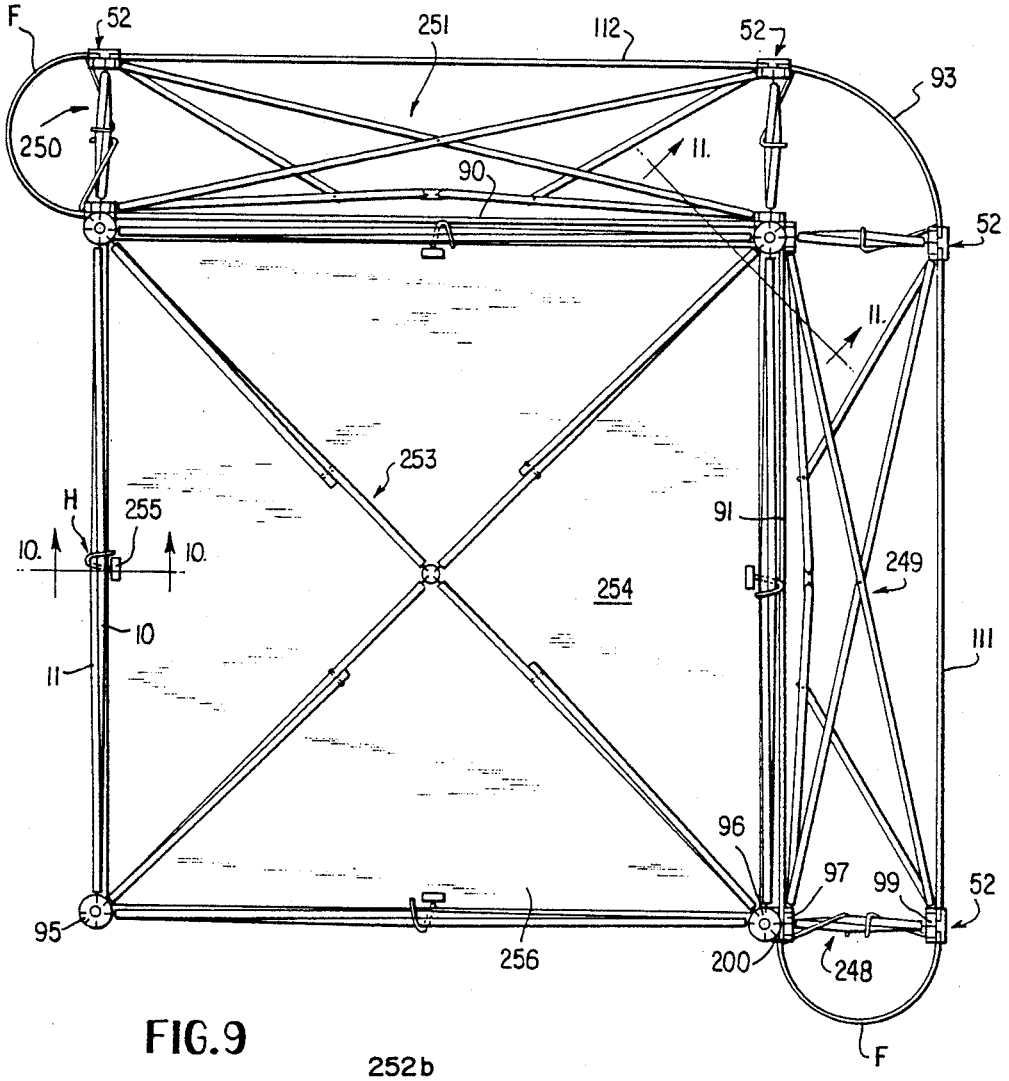
Figure 10:
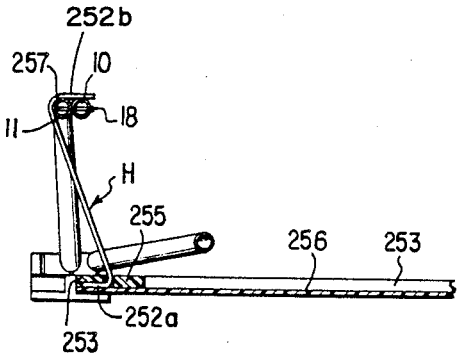
Figure 11:
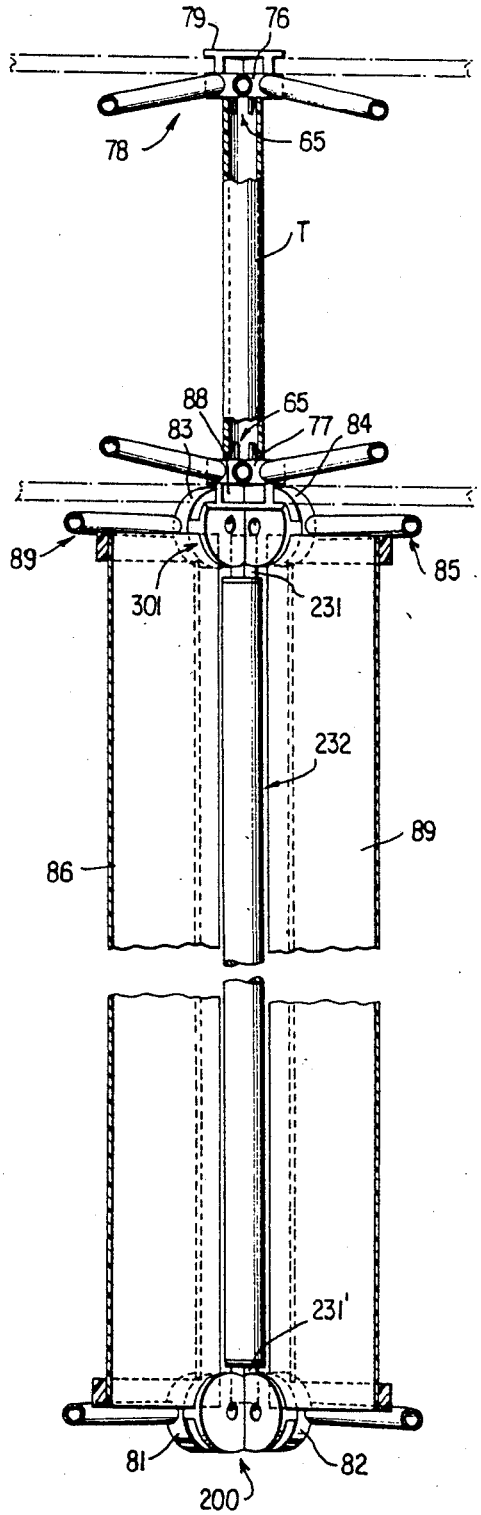
Figure 12:
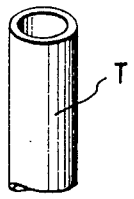
Figure 13:
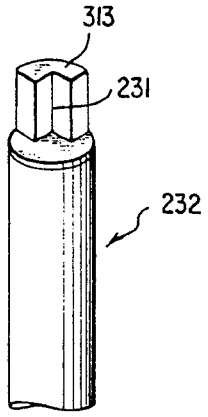
Figure 14:
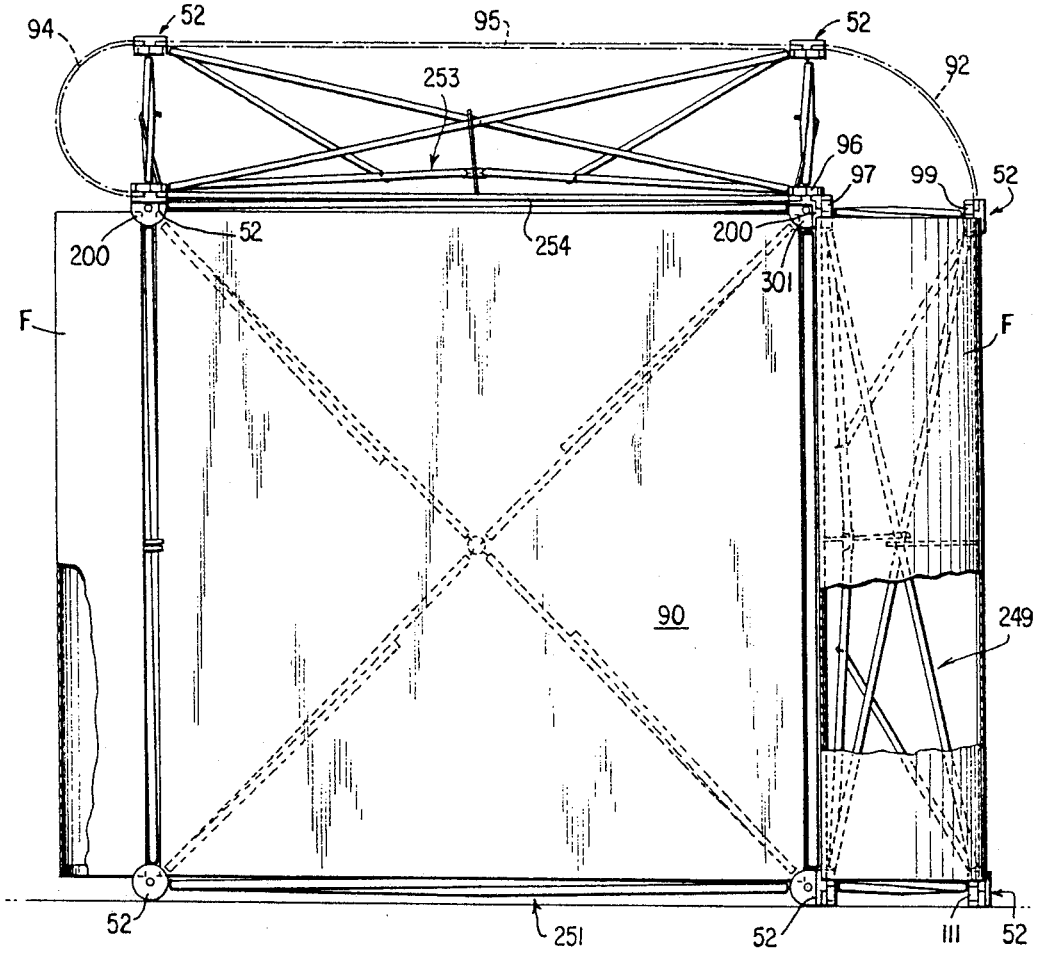
Figure 15:
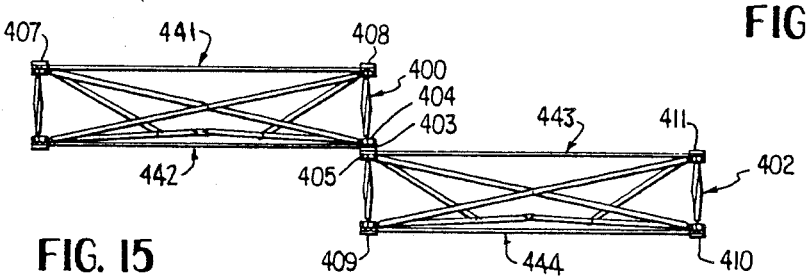
Figure 16:
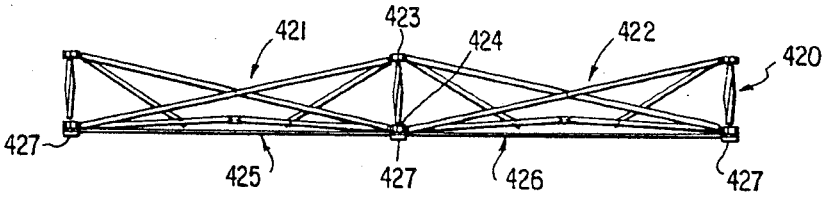
Figure 17:
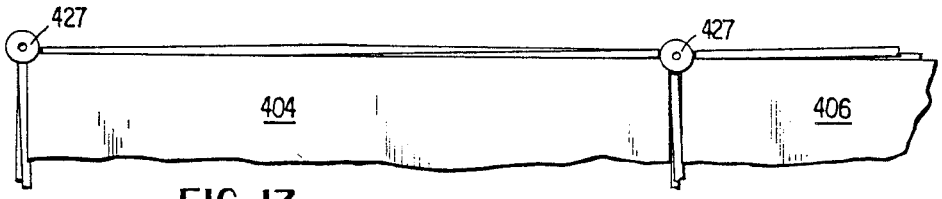
Figure 18:
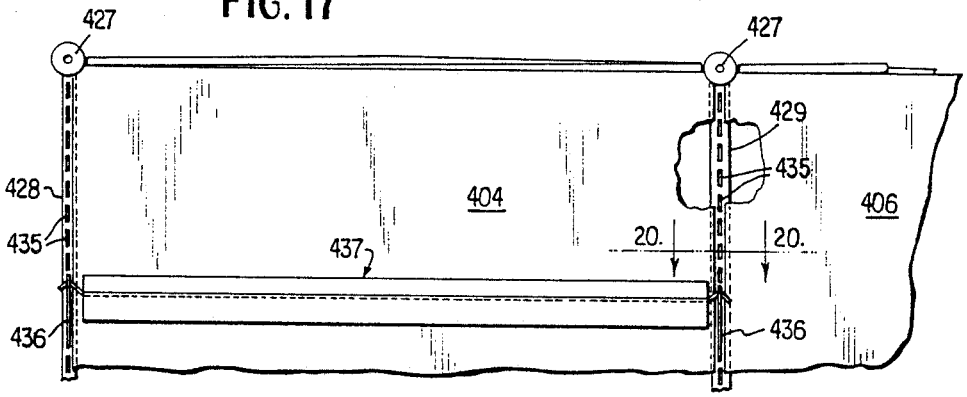
Figure 19:
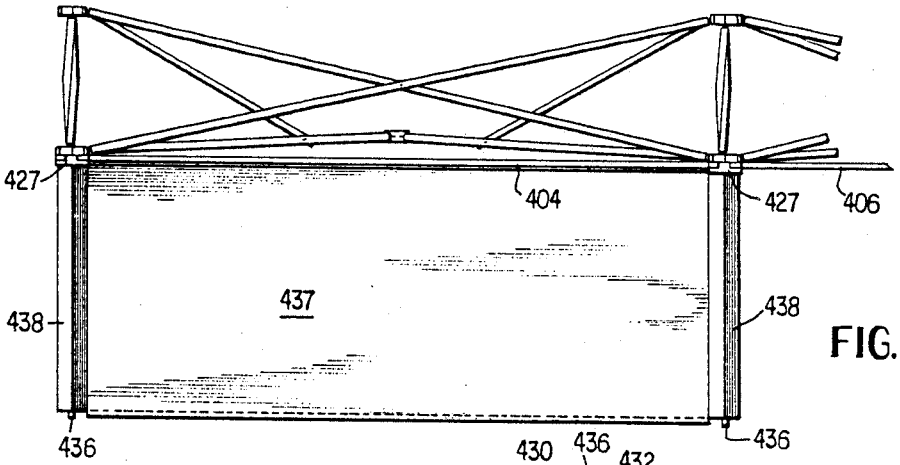
Figure 20:
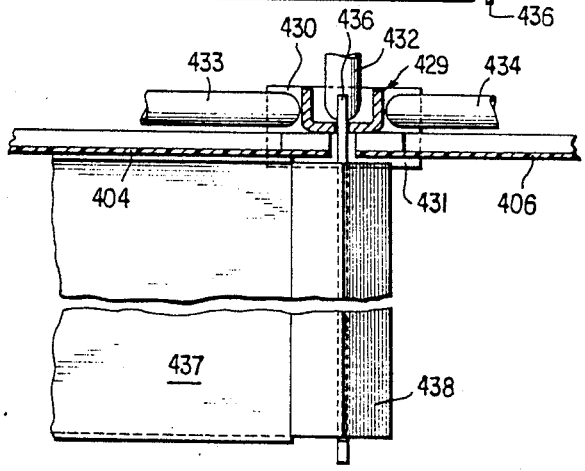

FIG. 2*a* is an enlarged section taken along the plane of section line 2*a*—2*a* in FIG. 2 and illustrating a module rigidifying structure;

FIG. 2*b* is an enlarged elevation, partly broken away, illustrating the corner recess relationship;

FIG. 2*c* is a side elevational view, partly in section, illustrating a hub and connector means;

FIG. 3 is a top plan view of the assembly of FIG. 2 with the panels in place but the rigidifying means being left out for clarity;

FIG. 4 is a top plan view illustrating the manner of attaching two modules in fixed relation along their intersecting and adjacent side edges;

FIG. 5 is a diagrammatic illustration of twelve modules diposed in clustered relationship around three axes of a basic configuration;

FIG. 6 is an enlarged portion of FIG. 5 Illustrating the three axes and the origin thereof;

FIG. 7 is a top plan view of three modules interconnected in accordance with this invention;

FIG. 8 is a side elevational view of a plurality of modules clustered about the three axis configuration;

FIG. 9 is a top plan view of a three axis configuration of modules illustrating some of the narrow side edge flexible panel covers;

FIG. 10 is an enlarged sectional view taken along section 10—10 in FIG. 9;

FIG. 11 is an enlarged sectional view taken along section line 11—11 in FIG. 9;

FIG. 12 is an end view of one configuration of a compression member;

FIG. 13 is an end view of another configuration of a compression member;

FIG. 14 is an elevational view of FIG. 9 and showing further panels and curved panels which may be associated therewith;

FIG. 15 illustrates two basic modules disposed in staggered, end-to-end relationship in accordance with this invention;

FIG. 16 is a pan view of a modified form of module configuration according to this invention;

FIG. 17 is an enlarged partial elevational view of the assembly of FIG. 16;

FIG. 18 is a view similar to FIG. 17 but illustrating a shelf construction and hanger therefor in accord with this invention;

FIG. 19 is a plan view of the assembly shown in FIG. 18;

FIG. 20 is an enlarged section taken along the plane of section line 20—20 in FIG. 18;

FIG. 21 is an exploded perspective view showing a basic configuration of a face pivot means and connector means in accord with this invention;

FIG. 21*a* is a plan view of the connector means illustrated in FIG. 21;

FIG. 22 is a view similar to FIG. 21 but illustrating a modified connector means in association with two face pivot means in accordance with this invention;

FIG. 23 is a view similar to FIG. 22 but showing a right angular connection between adjacent or touching face pivot means and the connector means for effecting such connection;

FIG. 23*a* is a side elevation of the connector means illustrated in FIG. 23;

FIG. 24 is an exploded perspective view illustrating three face pivot means and an associated three axis type of connector means for joining these face pivot means;

FIG. 25 is a perspective view similar to FIG. 24 but showing another viewing angle thereof; and FIG. 25*a* is a side elevation of the connector means illustrated in FIGS. 24 and 25.

DETAILED DESCRIPTION OF THE INVENTION

Referring now more particularly to FIG. 1, a preferred basic module of the present invention is illustrated therein, same being constructed in accord with the principles of my prior U.S. Pat. Nos. 3,968,808; 4,026,313; 4,280,521; 4,290,244; 4,437,275 and 4,473,986. The subject matters of which are incorporated herein by reference. For reasons which will be apparent hereinafter, the module of FIG. 1 has certain of the struts and the hub means which would otherwise pivotally interconnect the ends thereof removed, see particularly Derus RE 31,461, the subject matter of which is also incorporated herein by reference. The reason for this is to allow panels as hereinafter described to be affixed to both side faces of the module, but it is to be understood that the module may as well be of the form which allows a panel to be affixed to only one side thereof, i.e., to be of the form illustrated in my above-mentioned prior patents.

The module of FIG. 1 is of a self-supporting or self-locking type and is of parallelepiped form. The module is characterized by circumscribing pairs of scissored struts, one pair being indicated by their reference character 10 and 11, another pair by reference characters 12 and 13, a third pair by the reference characters 14 and 15 and the remaining pair being indicated by the reference characters 16 and 17. The struts 10 and 11 are pivotally connected by pivot means 18 which scissors the two struts 10 and 11 at their midpoints. Similarly, the strut pair 12, 13 is pivotally connected by the pivot means 19 at the midpoints of these struts 12 and 13; the two struts 14 and 15 are pivotally connected at their midpoints by the pivot means 20 and, finally, the strut pair 16, 17 is pivotally connected by the pivot means 21 at the midpoints or centers of the two struts 16, 17. In addition to this basic configuration of circumscribing pairs of scissored struts, the face pivot means 22, 23, 24 and 25 are arranged at one side or face of the erected, self-supporting module whereas the face pivot means 26, 27, 28 and 29 are arranged at the other side or face of the module. In this particular configuration, the lengths of all of the struts of the circumscribing pairs thereof are of equal lengths so that when the module is in the erected condition, the face pivot means 22–25 form a square planar array thereof at the corresponding side or face of the space frame construction of the module whereas the other face pivot means 26–29 form, similarly, a square planar array at the other side face of the module. It will be understood that other and different modules may be used if desired as, for example, those which have no self-supporting function or those which employ split hub constructions as disclosed in my prior U.S. Pat. No. 4,473,986 or my copending application 656,937.

The self-locking effect of the module of FIG. 1 is achieved by the combination of the four struts 30–33 in association with the four struts 34–37. The two diagonal struts 30, 34 are pivotally joined at the pivot means 38; the two diagonal struts 31, 35 are pivotally joined at the pivot means 39; the two diagonal struts 32, 36 are pivotally joined at the pivot means 40; and the two diagonal struts 33, 37 are pivotally joined at the pivot means 41. The lengths of the four struts 30–33 are the same but their length is longer than the length of any of the circumscribing pairs of struts. The struts 31–33 are respectively joined at one of their ends at the face pivot means 26–29 whereas the struts 34–37 are pivotally joined at one of their ends respectively to the face pivot means 22–25. The lengths of the struts 34–37 are the same but it is different from either that of the circumscribing pairs of struts or of the struts 30–33. To complete the assembly, the four struts 30–33 are pivotally joined by the hub means 50.

The self-locking or self-supporting effect is achieved in accord with disclosure of my prior U.S. Pat. No. 3,968,808, for example. Generally stated, the first rule (required for allowing the module to be collapsed fully so that a bundle of generally parallel struts results) is that for any opposed pair of hub means such as the opposed hub means 22, 26; 23, 27; 24, 28; or 25, 29, each pair of struts respectively pivoted thereto and which are also pivotally joined directly to each other, must be pivotally joined at a point such that the two distances, one distance being from the pivot connection of one strut at one hub means to the point of pivotal joining between the two struts, and the other distance being from the pivot connection of the other strut at the other hub means to the point of pivotal joining between the two struts, must yield a sum which is a fixed value. This first rule allows the module to be collapsed from the erected condition so that the struts are disposed in a bundle of generally parallel struts when the module Is in the collapsed condition. The second rule (required for self-locking) is that for the diagonal struts such as the struts 34–37 and 30–33, the two parts of this sum must be different. It can be shown that the fixed sum is equal to the length of any strut which is a circumscribing strut, i.e., equal to the length of a circumscribing strut such as 10 from its pivotal connection at one end to the hub means 22 to its pivotal connection at the opposite end to the hub means 27.

Thus, looking at the lower right corner of FIG. 1 for convenience, the first rule required is that the distance from the pivotal connection between the strut 14 and the hub 28 to the pivot means 20 plus the distance from the pivotal connection of the strut 15 and the hub 24 to the pivot means 20 must yield a sum of fixed value (the aforesaid length of a circumscribing strut) which must be observed for all other pivotally connected pairs of struts respectively connected to opposed hub means. Thus, the sum of the distance from the pivotal connection of the strut 32 to the hub 28 to the pivot means 40 plus that length of the strut 36 from the pivot point 40 back to its pivotal connection to the hub 24 must equal the fixed sum described above for the struts 14 and 15. Likewise, the length of the strut 12 from the hub 28 to the pivot means 19 and the length of the strut 13 from the pivot means 19 back to the hub 24 likewise is the aforesaid fixed value. As to the second rule, for the configuration shown, the length of the strut 36 from the hub 24 to the pivot means 40 is slightly greater than the length of the strut 32 from the hub 28 to the pivot means 40. This defines the necessary and sufficient conditions for the self-locking or self-supporting action. As noted, the lengths of the diagonal struts 30–33 are the same and their inner ends are pivotally interconnected by the hub 50. Likewise, the struts 34–37 are also of the same length from the various hubs 22–25 to the respective pivot means 38–41. It will be appreciated that the lengths of the struts 30–33 may be varied but it is generally not desirable that they be so short as to place the pivot means 38–41 coplanar with the hubs 26–29 when the module is erected or so close to a coplanar relation that the ends of the diagonal struts 34–37 will penetrate the plane defined by the faces of the face pivot means 26–29. However, on the other hand, the lengths of the struts 30–33 may not be so great as causes the pivot means 38–41 to be so positioned, observing the rule specified above, that the length of a diagonal strut such as 32 from the hub 28 to the pivot means 40 is exactly the same length as the length of the strut 36 from the pivot 40 to the hub 24. Such a disposition is a "neutral" condition in which no self-locking or self-supporting action occurs. In this "neutral" condition, the four pivot means 38–41 would lie in a plane midway between the planes of the face defined by the face pivot means 26–29 and the plane defined by the face pivot means 22–25. Thus, the plane containing the pivot means 38–41 must be offset to one side or the other of this "neutral" position.

Generally speaking, as the plane of the pivot means 38–41 approaches this "neutral" condition, the self-locking effect lessens whereas, to the contrary, as the plane of the pivot means 38–41 approaches the plane of either face pivot means set, the self-locking effect becomes progressively stronger. The degree of self-locking action should be such that the module is fairly rigid when erected but the stresses induced in the structural framework by virtue of the self-locking action should not be so great as either requires an inordinate degree of effort required to effect transition from the collapsed, bundled condition of the struts to the expanded or erected condition as is shown in FIG. 1 or requires the use of undesirably heavy materials to withstand the stresses induced by and during erection to the self-locking condition.

When the module is erected, connector means such as shown in FIG. 21 and indicated therein by the reference character 52 may be snapped into place relative to a face pivot means such as the face pivot means 23 illustrated in FIG. 21. The connector means 52 includes the circular face plate portion 53 provided on its inner face 54 with a cruciform rib assembly outstanding therefrom, as indicated by the reference characters 55, 56, 57 and 58. The inner faces of these ribs as indicated by their reference characters 59, 60, 61 and 62 are coplanar and are adapted to engage against the outer face of the face pivot means 23 and define a set of four corner recesses in association therewith. Each such corner recess is defined by adjacent side faces 63 and 64 of two adjacent ribs 55 and 56, for example, and the inner face portion 54 intervening therebetween and the opposed surface of the face of the face pivot means 23. Each connector means is provided with a bifurcated snap fastening means indicated generally by the reference character 65 which is of tubular configuration where it joins the ribs 55–58. Beyond this tubular configuration, the means 65 is bifurcated as shown by the generally V-shaped slots 42 and 43 disposed in diametrically opposed relationship in the tubular configuration to present the first and second prongs 66 and 67 whose outer diameter is substantially the same as the inner diameter of the opening 70 through the associated face pivot means 23. Each prong 66 and 67 carries a laterally projecting camming member 71, see also FIG. 21*a*, having a relatively gentle ramp 75 to allow the bifurcations to squeeze together as the means 65 is forced into and through the opening 70 and a rather sharp ramp surface 76 (see FIG. 2*c*) is provided on each of the devices 71 on the rear side thereof facing the ribs so that when the members 71 pass beyond the opening 70, the bifurcations spring apart and latch or releasably lock the connector means 52 to the face pivot means 23. For this purpose, it will be seen from FIG. 2*c* that the length of the means 65 between the ends of the sharp ramps 73 and the ribs is substantially equal to the thickness of the face pivot means 23. FIG. 2*c* also shows the mild ramp 75 which permits the easy insertion.

Two of the corner recesses are indicated by the reference character R in FIG. 2*c* and the manner in which one of these cooperates with a panel P is shown more clearly in FIG. 2*b*. For the sake of accuracy, it will be noted that the illustration in FIG. 2*b* relates to the connector means 80 in FIG. 2, the panel P as indicated therein and the corresponding face pivot means 29 of the module illustrated in FIG. 1. To illustrate the construction in better detail, portions of the face pivot means 29 have been broken away in FIG. 2*b* and this also illustrates in better detail the preferred form of construction of each face pivot means 29 or a hub as utilized in this invention. Such construction is in conformity with my prior U.S. Pat. No. 4,280,521 and embodies a pair of discs adhesively secured together and having opposed faces defining a circular channel in which the ring 100 is received, same being discontinuous as indicated at reference 102 which discontinuity is disposed between any convenient pair of the radial slots S which are adapted to receive the blade ends B of the struts, see for example the blade end B for the strut 12 in FIG. 21. Each such blade is provided with a circular opening through which the ring 100 passes and the slots S are deep enough to allow the requisite pivotal action of the struts relative to the hub means.

In FIG. 2*b*, the two ribs 101 and 102 of the connector means 80 in combination with the inner face of the connector means 80 and the opposed face of the face pivot means 29 define the corner recess within which a corner of the panel P is engaged, being disposed within and held captive by the recess. Preferably, as is shown in FIG. 2*b*, the panel P includes a circumscribing thickened frame portion 103 and a thinner plate portion 104 substantially as is shown. Again, preferably, the frame 103 and the material 104 are sufficiently flexible as to allow the panel to be snap fitted into place once all of the connector means are associated with the corresponding face pivot means 26–29. The manner in which the panels P may be snap fitted into place is illustrated in FIG. 2 wherein it will be seen that the corner 105 is in the process of being engaged in a corner recess provided by the connector means 106 and its associated face pivot means 26, as permitted by the flexibility of the panel P. It will be appreciated that each of the connector means thus far illustrated and described is rotatable with respect to its face pivot means but that when the corners of the panel P are snapped into place, the rotational orientation of each of the connector means is established thereby. Preferably, the flexible panels P do not significantly if at all serve as rigidifying means for the module, although such may be utilized if desired, in which case the panels P should be more or less rigid. For example, it is possible to utilize modules which have no self-locking or self-supporting action whatsoever and to utilize, instead, the rigidity of the panels P as the means which serves to allow the module plus panel or panels to be a relatively rigid and self-supporting structure. As an example, it is perfectly possible to utilize a "neutral" type of module where no self-locking action is possible and to employ a panel on either side of the module, with associated connector means on each face pivot means to effect a rigid, self-supporting module-plus-panel assembly.

Another method of rigidifying the module whether it be of the self-locking type or not is illustrated in FIG. 2 and, in greater detail in FIG. 2*a*. With reference to FIG. 2*a*, it will be seen that the two connector means 107 and 108 are associated respectively with the two face pivot means 27 and 23 and that a compression tube T is positioned between the inwardly facing inner faces of the two face pivot means 27 and 23, the ends of the tube T being centered by the inwardly projecting portions of the means 65. To hold the tube T under compression, a bolt B is passed through the assembly as is illustrated and a nut N is associated therewith and tightened sufficiently to effect the requisite rigidification. The tube T and bolt B with its nut N may be utilized with or without a self-locking module, as may be desired and may also be used with a flexible pane P or with a rigid panel. Obviously, the rigidifying means in the form of the tube T, the bolt B and the nut N may be utilized at any or all points of a module between the face pivot means which are disposed in opposed relationship, as for example between the pivot means 26 and 22, etc. However, it should be noted that the choice of whether to employ the rigidifying means T alone or in conjunction with the bolt B and its nut N is dependent upon the orientation thereof within the framework assembly. That is, when the tube T is to be arranged vertically, there may be no need for the Bolt B and its nut N since the vertical orientation of the tube may well be sufficient to provide the correct line of force transfer to relieve the framework, or more importantly the module or adjacent modules from the forces acting thereon which would otherwise distort them. This is explained further in connection with FIG. 11. The important point is that the rigidifying means, no matter what form it takes, should prevent the framework from being distorted, twisted or the like, by the action of transferring forces which would act directly on the framework through the rigidifying means. This is very important in relieving flexible panels of being subjected to forces which would buckle them and present an unsightly appearance. The same is even true where the panels are themselves fairly rigid because the rigidifying means the relieves the panels from taking more force than is intended.

As is also shown in FIG. 2, a second panel 110 may be disposed on the opposite side face of the module and associated therewith by the corner recesses provided by the requisite connector means in the same fashion as the panel P. A top plan view of such an assembly is shown in FIG. 3, the compression sleeve T, bolt B and nut N being omitted in the FIG. 3 showing to illustrate that a completed module assembly does not require such a rigidifying means in every instance.

FIG. 5 illustrates the manner in which modules as in FIGS. 1 and 2 may be utilized in a basic three axis configuration to form many and diverse forms of exhibit configurations. In FIG. 5, there are twelve modules illustrated diagrammatically which are grouped or clustered around the three axes 120–120, 122–122 and 124–124. These axes are orthogonal and define the origin 0 which is shown in greater clarity in FIG. 6. The modules 130, 132, 134 and 136 are clustered around the axis 122–122 on one side of the origin 0 while the modules 138, 140, 142 and 144 are clustered around the axis 122 on the other side of the origin. Likewise, the modules 138, 146, 130 and 148 are clustered around the axis 124–124 above the origin 0 whereas the modules 142, 150, 134 and 152 are clustered around the axis 124–124 below the origin 0. There are twelve models in FIG. 5 which are all equidistantly spaced from the origin 0 which is centered within the imaginary cube indicated generally by the reference character 160 in FIG. 6. This cube is defined at the intersection of the three hollow channels centered on the corresponding axes 120–120, 122–122 and 124–124, such channels being indicated generally by the reference characters 162, 164 and 66 in FIG. 5. The modules which are clustered around any particular axis are equidistantly spaced therefrom all along corresponding side edges thereof and, as noted, the entire twelve modules of FIG. 5 are equidistantly spaced from the origin 0.

FIG. 7 illustrates three modules 152, 154 and 134 depicted diagrammatically in FIG. 5 to illustrate a basic configuration which may be utilized although it will also be understood that an L-shaped configuration is also possible consisting of only two modules as for example modules 152 and 134. When an adjacent pair of modules 132 and 134 or 134 and 154 are disposed as in FIG. 7, connector means as is illustrated in FIG. 23 are utilized. As is Illustrated in FIG. 23, the right angular connector means 200 includes two perpendicularly arranged part circular face plates 201 and 202, the inner faces 203 and 204 of which are provided with the cruciform ribs similar to the configuration of FIG. 21 except that the ribs 205 and 206 are integrally joined for greater strength, the remaining ribs on the two face plates 201 and 202 being indicated by the reference characters 207–212. The central portion of each cruciform configuration is provided with a laterally projecting snap fitting means 65.

With reference to FIGS. 1 and 4 simultaneously, primed reference characters being utilized for the right-hand module in FIG. 4, it will be seen that the two modules illustrated are orthogonally arranged with the face pivot means 27 and 26' and 28 and 24' of the two modules in substantially touching relationship along the vertical side edges of these two modules. It is these two sets of face pivot means which receive the connector means 200 illustrated in FIG. 23, the uppermost right angular connection means 200 being illustrated at 215 in FIG. 4 connecting the face pivot means 27 and 26' substantially as is shown. Thus, two of the means 200 are utilized in FIG. 4 whereas four of the single connectors shown in FIG. 21 are also utilized, those being the connector means 106 and 80 of FIG. 2 and their corresponding primed single connector means as is illustrated.

It will be noted that the connector means 200 of FIG. 23 serves to provide only four corner recess means which are accessible to the panels P, these being the recess means 220 and 221 and the potential recess means 222 and 223. The recesses 220 and 221 respectively receive the corners 224 and 225 of the panels P' and P of FIG. 4 and the recesses 222 and 223 could receive the corners of other panels if they were present. The ribs 205 and 206 define an L-shaped surface 226 and a similar surface underneath, the inner face portions 227 and 228 of the face plate portions 201 and 202 defining a corner 229 and, beneath this corner, a further corner 230. These corners are adapted to nest within a corner 231 of a compression strut 232 illustrated in FIGS. 11 and 13 as described hereinafter.

It will be appreciated that two more panels may be used in FIG. 4, one on each of the other sides of the two modules shown.

FIG. 7 illustrates an arrangement of three modules 134, 152 and 154 (see also FIG. 5) clustered with respect to the vertical axis 124–124, with the panels 233, 234, 235, 236, 237 and 238 in place. In this configuration, a total of sixteen single connector means 52 of FIG. 21 are used and a total of four right angle connector means 200 of FIG. 23 are also used.

FIG. 8 illustrates in plan view the diagrammatic arrangement of FIG. 5, consisting of a total of twelve modules. The panels 240–243 are on the top sides of the respective modules 144, 140, 132 and 136 of the modules shown in FIG. 5; the panels 244–247 are on the opposite sides of the respective modules 138 and 130; and a similar arrangement of panels may be used below the origin 0.

It will be appreciated that various and different arrangements of modules may be used, dependent upon the desires of the user, and that various and different arrangements of panels may also be employed, as desired.

FIG. 9 illustrates the use of further panels to fill in over a narrow side of a module or between the narrow sides of adjacent modules. These further panels are narrower than the previously described panels P but are of the same height and as with the previously described panels such as P, employ a circumscribing frame. The use of a further panel F to fill in or cover the narrow side 248 of the module 249 is shown at the lower right of FIG. 9 and to cover the narrow side 250 of the module 251 is shown at the upper left of the Figure.

As will be evident, these further panels lend a pleasing appearance to the assembly to round off the structure and cover the frameworks of the modules. As shown for the two panels F, they may be used where a narrow side of a module is exposed and a panel of the same dimensions may also be used to cover over between the exposed narrow sides of two adjacent panels as illustrated by the panel 93. As is the case for the large panels, the smaller panels F are positioned with their corners in corner recesses provided by the connector means. Additionally, hook means are provided to hold the smaller panels in place. Such hook means may also be used for the larger panels P as shown in FIG. 10. In FIG. 10, the hook means H are of generally Z-shape with one end 252 rotatably received in the frame of the large panel 254 and the block 255 of material is adhered to the panel cover 256 to retain the end 252*a* of the hook means against withdrawal from the groove in the frame of the panel 254. The other end 252*b* of the hook means H is engaged over the crossing point of the struts 10 and 11 (referenced to FIG. 1) where the rivet 257 forms the pivot means for allowing the scissoring action between the struts 10 and 11, see particularly FIG. 9.

FIG. 14 is an elevational view of FIG. 9 and illustrates further details thereof. Thus, the panel 90 of which only one edge is shown in FIG. 9 is shown in elevation in FIG. 14 and the panel 91 whose edge only is seen in FIG. 9 is not seen in FIG. 14 because it is hidden by the further panel F on the module 249. However, FIG. 14 does show potential placement of a further panel 92 which, like the panel 93 of FIG. 9, is of the 90° type rather than the 180° type as for the further panels F in FIG. 9. Another potential 180° further panel 94 and a large panel of the P type are also shown in FIG. 14. Some of the connector means locations will be apparent from a study of FIG. 9 and 14. A single connector means of the 52 type shows at the upper left of FIG. 14 and it is the one connected to the face pivot means 95 at the lower left of FIG. 9. Behind this connector means in FIG. 14 is the connector means of the 200 type which serves to connect adjacent face pivot means of the two modules 251 and 253. The double connector means of the 200 type which connects the face pivot means 96 and 97 of the two modules 253 and 249 in FIG. 9 is shown at the upper right of FIG. 14 whereas behind this is seen a portion of the connector means of the 301 type which serves to join the upper adjacent face pivot means of the three modules 249, 251 and 253. At the lower right, the single connector means of the 52 type which is connected to the face pivot means 98 of the module 249 is shown. This connector means not only serves to provide a corner recess for the further panel F but also for the panel 91. Two further connector means of the 52 type are shown at the right on FIG. 14, one connected to the face pivot means 99 of the module 249 as seen in FIG. 9, and one connected to another face pivot means 111 of this same module. Still further connector means of the 52 type are shown in both Figure for obvious purposes, among which is to provide suitable corner recesses such as for the large panel 112 shown in FIG. 9.

FIG. 11 illustrates further rigidifying means of this invention. The tube T as was also used in the assembly of FIG. 2*a* in a slightly different way in FIG. 11. In FIG. 11, the tube T (see also FIG. 12) is positioned vertically to form a compression strut between opposed face pivot means 76 and 77 of the same module 78. Two other modules 85 and 89 are also shown, the module 89 having the two face pivot means 81 and 83 and the module 85 having the two face pivot means 82 and 84. The three face pivot means 77, 83 and 84 are joined by the connector means 301 of the type illustrated in FIG. 24 (or 25) whereas the face pivot means 76 has the connector means 79 engaged therewith, same being of the FIG. 21 type. The tube T at its upper end receives the snap fastening means 65 of the connector means 79 and the lower end of the tube T receives one of the snap fastening means 65 of the connector means 301. The compression strut 232 has its upper end 231 received in the pocket 300 of a connector means 301 such is shown in FIG. 24. Views of this type of connector means are illustrated in FIGS. 24, 25 and 25*a* which will be described later. The lower end 231' of the tube 232 is received in a pocket of a connector means 200 such as is illustrated in FIG. 23. The relevant pocket is one such as the pocket above or below the L-shaped surface 226 in that Figure, dependent upon the orientation of the connector means 200. In any event, the end face 313 of the strut lower end 231' seats upon a surface such as the surface 226 with the notch of that end receiving the relevant surfaces 227 and 228 of the connector means 200. A similar situation prevails for the upper end 231 of the compression strut 232, the end face 313 seating on a surface such as that indicated at 98 in FIG. 24 but within the pocket 300. Thus it will be seen that the tube T and the compression strut or member 232 cooperate to transfer loads downwardly without passing through the modules. In the particular configuration shown, the two modules 85 and 89 are braced or rigidified against extraneous stress. This serves to relieve the two panels 86 and 87 of the strain which would be present if the modules were deformed or in any way distorted by these forces and which would cause the panels 86 and 87 to buckle or bulge in any way, causing an unsightly appearance. In fact, the need for rigidifying means is made evident in the system by observing the panels and, if any one or more of them is buckled or deformed, it is a simple matter to insert the requisite rigidifying means to correct for this.

FIG. 11 clearly shows how the side edges of adjacent modules 85 and 89 are joined through the connector means 200 and 301 and how the third module is also joined through the connector means 301 so that two of its side edges lie along and adjacent to respective sides of the other two modules 85 and 89. The various connector means on the two modules 85 and 89, including the connector means 200 and 301 visible in the Figure, serve to mount the panels 86 and 87 and the bottom face of the module 78 may also mount a panel, one corner recess for so doing being indicated at 88.

A connector means such as the connector means 301 of FIG. 25*a* is employed to connect three face pivot means 305, 306 and 307 of orthogonally related modules as is illustrated in FIG. 24. These connector means are associated with the corners of the faces of three corresponding modules defined by the associated face pivot means 305, 306 and 307 to which the respective struts 314–316, 317–319 and 320–322 are connected. Such a three axis connector means would be used where the corners of three modules are in substantially touching relation and are required to be joined. Three corner recesses are provided at such a point and three panels can therefore be accommodated on the corresponding faces of the modules in question. Such intersections are illustrated in FIG. 8, for example. In this Figure, four different modules are shown having panels 302, 303, 304 and 308 in elevation, associated with the modules indicated generally by the reference characters 309, 310, 311 and 312. In addition, four more modules 324, 326, 328 and 330 are visible, in which it will be seen that the adjacent faces of the three modules 309, 324 and 330 are joined by the connector means 331 which is of the type illustrated in FIG. 24. Also, a single connector means 332 on a face pivot means of the module 309 and of the type illustrated in FIG. 21 is visible. Further, a connector means 333 of the FIG. 21 type is visible on the upper corner face of the module 330 and, behind it, the double connector means 334 of the FIG. 23 type which joins the corner between adjacent edges of the two modules 309 and 330. Also visble is the single connector means 335 at the corner of the module 324 and, behind it, the double connector means 336 to connect the two modules 309 and 324 along their adjacent side edges. Also visible is the double connector means 337 which joins the two modules 324 and 330 at the nearest corner along their adjacent side edges and, behind it, the previously mentioned triple connector means 331. The connector means 332 is connected to the face pivot means of the module 309 immediately behind it; the connector means 334 is connected to the face pivot means of the module 309 immediately behind it and to the face pivot means of the module 330 immediately below it; the single connector means 332 is connected to the visible face pivot means 338 of the module 330; the double connector means 337 is connected to the visible face pivot means 339 and 340 of the two modules 330 and 324; the single connector means 335 is connected to the visible face pivot means 341 of the module 324; the connector means 331 is connected to face pivot means of the three modules 309, 324 and 330; and the double connector means 336 is connected to face pivot means of the two modules 309 and 324. For orientation purposes, the triple connector means 331 in FIG. 8 is shown in FIG. 25 with the three face pivot means 350, 352 and 352 corresponding to the face pivot means of the respective modules 309, 324 and 330. In FIG. 25, the face 353 of the connector means 331 is partially visible in FIG. 8.

It will be evident from FIGS. 21, 23 and 24, 25 that by "single", "double" and "triple" as used above, is meant that the connector means in question has one, two or three projections 65 as was described in conjunction with FIG. 21. In the case of FIG. 23, the bifurcated projections 65, 65 are at right angles to each other and in FIGS. 24 and 25, they are orthogonal to each other. It should also be evident that the various connector means may assume any position in an arrangement of modules by simple rotational orientation. That is, all single connector means, all double connector means and all triple connector means as shown in FIG. 21, 23 and 24, 25 respectively are identical to each other.

A different connector means is illustrated in FIG. 22 and is used in the form of module arrangement illustrated in FIG. 15. In this Figure, two modules 400 and 402 are illustrated but which are disposed in offset relation and have their adjacent side edges joined by a pair of connector means of which one is visible in FIG. 8 and is designated by the reference character 403 joining the two face pivot means 404 and 405. The two modules 400 and 402 have been provided with four panels 441, 442, 443 and 444 and the requisite number of connector means are provide to mount these panels. For this purpose, two of the four single connector means needed to mount the panel 441 are visible at 407 and 408; two, of the four single connector means needed to mount the panel 444 are visible at 409 and 410; and one of the two offset connector means 403 and one of the two single connector means needed to mount the pane 443 are visible. The offset connector means 403 are, in many respects, similar to the connector means previously described as will be evident from FIG. 22. Thus, the offset connector means 412 includes the disk-like main body portion 413 but which in this case is double sided, having cruciform rib formations 414 and 415 on both sides and, in addition, bifurcated projection means 65 which are oppositely directed but in line or coaxial. These connector means serve to connect spaced, opposed face pivot means 416 and 417 along the adjacent side edges of two modules as in FIG. 15. This arrangement may be used to extend any module arrangement where desired.

An alternate way to extend a module arrangement is by use of a modified form of module as in FIG. 16. In this Figure, the module 420 is twice as long as the modules previously described, comprising a first module section 421 and a second module section 422 which are integrally formed by sharing certain common face pivot means such as the face pivot means 423 and 424 as shown. Otherwise, the construction is the same as described above. It will be evident that the length may be extended as desired and, as well, the height may also be extended. As before, panels may be placed on both sides of the module assembly but only two are illustrated at 425 and 426 in FIG. 16, suitable single connector means 427 being requIred in the configuration shown. To elucidate, a partial elevation is shown in FIG. 17. It will be noted that when a panel is in place, its side edges expose the circumscribing pairs of struts behind the panel. This is evident particularly in FIGS. 17 and 18, the latter Figure illustrating a special use which can be made of this relation.

Thus, referring to FIGS. 18–20, vertical compression members 428 and 429 will be seen which are of channel shape as seen in FIG. 20 and their opposite ends cooperate with the struts and the face pivot means and additionally with the connector means and the panels to hold the compression members in place. Thus, the face pivot means 430 illustrated in FIG. 20 in cooperating with the connector means 431, the circumscribing strut 432 and the diagonal struts 433 and 434 together with the panels 442 and 444, form a nest within which the lower end of the compression member 429 seats. This is a natural consequence of the channel shape of the member 429 and its lower end as can be seen in FIG. 20 is held captive in the seat or nest so formed. The length of the member is such that the same relation holds for the upper end of the compression member. Since the compression members are aligned with the face pivot means, they bridge the gap between two panels, as shown. These compression members are slotted as at 435 which allows conventional bracket arms 436 to be engaged therewith through the slots 435 to support suitable shelving 437. The shelving may be metal having V-shape side edges 438 seated upon the shelf arms 436, as shown. The members thus serve not only to reinforce the modules where they are used, but they also offer the opportunity for mounting shelves where desired.

It will be understood that the connector means may take other and different forms from those specifically shown. For example, a double, in line connector means may be used to connect any two modules in end-to-end or aligned relation. Further, this type of connector means may also take the form of pivoted, side-by-side members so as to allow adjacent modules to be disposed at various angles with respect to each other, a similar type of arrangement, without the corner recess means, being shown in my patent issuing June 11, 1985. Also, the connector means may cooperate with the hubs to allow them to be connected without pivotal motion therebetween, thereby to orient the corner recesses properly whenever the connector means is snapped into its associated hub means.

What is claimed is:

1. A three dimensional modular structure which comprises the combination of:

a plurality of modules, each comprising a plurality of struts and pivot means joining said struts so that the struts are movable between a collapsed condition in which the struts are bundled in generally parallel relation and an expanded condition in which certain of said pivot means define fact pivot means lying in a planar array at one side of the expanded module, and the modules being arranged in a pattern defining first, second and third intersection axes in which pairs of said face pivot means of adjacent modules are disposed in adjacent relation;

connector means removably received in said pairs of face pivot means of adjacent modules for joining said modules to form the three dimensional structure and simultaneously defining corner recesses with their associated face pivot means; and at least one panel having means received and held captive in a plurality of said corner recesses.

2. A three dimensional modular structure as defined in claim 1 wherein said face pivot means lie in a rectangular planar array and said panel is of rectangular configuration.

3. A three dimensional structure as defined in claim 1 wherein each of said modules is self supporting and said panel is sufficiently flexible as to be flexed into and out of said corner recesses.

4. In a modular system as defined in claim 3 wherein there are four modules having faces parallel to said second of said axes.

5. A three dimensional structure as defined in claim 4 wherein the corner recesses in which said panel is held captive are disposed in a planar array thereof.

6. In a modular system as defined in claim 5 wherein there are four modules having faces parallel to said third of said axes.

7. A three dimensional structure as defined in claim 3 wherein the corner recesses in which said panel is held captive are disposed at opposite sides of the same module and hook means engaging elements of said same module for retaining said panel in place.

8. A three dimensional structure as defined in claim 3 wherein the corner recesses in which said panel is held captive are disposed on two of said modules and hook means engaging elements of said two of said modules for retaining said panel in place.

9. In a modular system as defined in claim 1 wherein there are four modules having faces parallel to said first of said axes.

10. An assembly for display or similar purposes, which assembly includes:

a space frame structure defining a series of open regions;

a plurality of individual modules each defining at least one of said open regions, each module comprising a plurality of struts pivotally joined together so as to be manipulated between a collapsed condition in which the struts are in a compact bundle in generally parallel relation and an expanded condition in which the struts define a three dimensional form having face pivot means at ends of the struts defining corners of one of said open regions; and rigid connector means joining at least two of said modules when in expanded condition in parallel, offset relation.

11. An assembly as defined in claim 10 wherein said open regions are squares.

12. A structure as defined in claim 10 wherein some of said modules are arranged in perpendicular relation.

13. An assembly for display or similar purposes, which assembly includes:

a plurality of expandable/collapsible modules each adapted to be expanded into individual space frame configuration and be arranged in a selected pattern of such expanded modules to form a desired composite space frame structure;

means for joining said modules in said selected pattern to form said space frame structure and simultaneously defining at east one set of corner recesses arranged in a planar array thereof; and at least one panel having means held captive within said planar array of corner recesses.

14. An assembly as defined in claim 13 said one set of corner recesses are arranged in a rectangular array.

15. An assembly as defined in claim 14 wherein said panel is sufficiently flexible as to flex into and out of said corner recesses.

16. An assembly as defined in claim 14 wherein said modules are self supporting in expanded condition.

17. An assembly as defined in claim 13 wherein said panel is sufficiently flexible as to flex into and out of said corner recesses.

18. An assembly as defined in claim 14 wherein said modules are self supporting in expanded condition.

19. In a three dimensional structure for display or similar purposes, a module comprising a plurality of struts and pivot means pivotally joining said struts together so that the struts may be manipulated between a collapsed condition in which the struts are in generally parallel relation in a compact bundle and an expanded condition in which the struts define a three dimensional form having certain of said pivot means defining a planar array thereof;

means removably received in said certain pivot means and defining corner recesses therewith; and a panel having means received and held captive within said corner recesses.

20. In a three dimensional structure as defined in claim 19 wherein said certain pivot means define a rectangular planar array.

21. In a structure as defined in claim 19 wherein said array is a square.

22. In a structure as defined in claim 19 wherein said panel is sufficiently flexible as to be flexed into and out of said corner recesses.

23. In a structure as defined in claim 19 wherein said certain pivot means define the corners of at least two adjacent squares, said means defining corner recesses with said certain pivot means and there being at least two square panels having their corners received in respective corner recesses so that said panels are side-by-side.

24. In a structure as defined in claim 23 wherein said panels are sufficiently flexible as to flex into and out of said recesses.

25. An assembly for display or similar purposes, which assembly includes:

a composite space frame structure comprising a plurality of three-dimensional modules, each providing a plurality of sides, said modules being arranged relative to each other to define a three axis composite space frame structure which may be extended in the direction of each axis by module addition;

each module comprising a plurality of struts and pivot means for pivotally joining said struts so as to be manipulated between a collapsed condition in which the struts are in a compact bundle in generally parallel relation and an expanded condition in which the struts define a three dimensional open form having said plurality of sides, said pivot means including face pivot means at ends of those struts defining corners of two opposite sides of the module with the face pivot means on each of said opposite sides being substantially coplanar; and connector means joining said face pivot means of adjacent modules when in expanded condition for connecting said modules in adjacent relation so as to form said space frame structure.

26. An assembly as defined in claim 25 wherein said assembly is disposed in fixed relation to three intersecting axes defining an origin at their point of intersection, at least two of said modules having faces parallel to one of said axes, at least two of said modules having faces parallel to another of said axes, and at least two of said modules having faces parallel to the third of said axes.

27. An assembly as defined in claim 26 wherein three of said modules have faces parallel to said one of said axes.

28. An assembly as defined in claim 27 wherein three of said modules have faces parallel to said another of said axes.

29. An assembly as defined in claim 28 wherein three of said modules have faces parallel to said third of said axes.

30. An assembly as defined in claim 26 wherein four of said modules have faces parallel to said one of said axes.

31. An assembly as defined in claim 26 wherein four of said modules have faces parallel to said another of said axes.

32. An assembly as defined in claim 26 wherein four of said modules have faces parallel to said third of said axes.

33. An assembly as defined in claim 25 wherein said two opposite sides are parallel.

34. An assembly as defined in claim 25 wherein said modules are clustered around the axes defining said three axis composite space frame system.

35. An assembly as defined in claim 34 wherein each of said modules is of parallelepiped form.

36. An assembly as defined in claim 34 wherein said opposite sides of each module are square.

37. An assembly as defined in claim 34 wherein the axes of said three axis composite space frame system are orthogonal.

38. An assembly as defined in claim 25 wherein each of said modules is of parallelepiped form.

39. An assembly as defined in claim 38 wherein said opposite sides of each module are square.

40. An assembly as defined in claim 39 wherein the axes of said three axis composite space frame structure are orthogonal.

41. An assembly for display or similar purposes, which assembly includes:

a composite space frame structure comprising a plurality of three-dimensional modules, each providing a plurality of sides, said modules being arranged relative to each other to define a three axis composite space frame structure which may be extended in the direction of each axis by module addition;

each module comprising a plurality of struts and pivot means for pivotally joining said struts so as to be manipulated between a collapsed condition in which the struts are in a compact bundle in generally parallel relation and an expanded condition in which the struts define a three dimensional open form having said plurality of sides, said pivot means including face pivot means at ends of those struts defining corners of two opposite sides of the module with the face pivot means on each of said opposite sides being substantially coplanar;

connector means joining said face pivot means of adjacent modules when in expanded condition for connecting said modules in adjacent relation so as to form said three axis composite space frame structure; and each of said connector means defining a corner recess with a corresponding module, and a panel having means received in an array of said corner recesses associated with a module.

42. An assembly as defined in claim 41 wherein said panel is sufficiently flexible to be flexed into and out of said corner recesses.

43. A composite space frame structure fixed relative to three intersecting axes and to the origin defined by the point of intersection of such axes, said composite space frame structure comprising the combination of:

a plurality of space frame modules; and connector means for detachably connecting said modules in a fixed and spaced pattern relative to said origin and to said three axes such that all of the modules are equally spaced from said origin while one pair of two of said modules are equally spaced from all points along one of the three axes, another pair of two of said modules are equally spaced from all points along another one of said three axes, and a further pair of two of said modules are equally spaced from all points along the last of said three axes.

44. An assembly as defined in claim 43 wherein each of said modules is of parallelepiped form.

45. An assembly as defined in claim 43 wherein each of said modules is constructed of a plurality of struts and is collapsible from its space frame configuration to a bundle of generally parallel struts.

46. An assembly as defined in claim 45 wherein each module includes circumscribing pairs of struts disposed in crossed relation and pivot means for pivotally joining each such pair of struts in said crossed relation.

47. An assembly as defined in claim 46 wherein each module further includes strut means for self-locking said module in expanded, space frame configuration.

48. An assembly as defined in claim 47 wherein said strut means comprises a plurality of pairs of pivotally connected diagonal struts extending inwardly from and pivotally connected to said circumscribing pairs of struts.

49. An assembly as defined in claim 48 including face pivot means for pivotally connecting the ends of said circumscribing pairs of struts to each other and to ends of said diagonal struts.

50. A composite space frame structure fixed relative to three intersecting axes and to the origin defined by the point of intersection of such axes, said composite space frame structure comprising the combination of:

a plurality of space frame modules;

connector means for detachably connecting said modules in a fixed and spaced pattern relative to said origin and to said three axes such that all of the modules are equally spaced from said origin while one pair of two of said modules are equally spaced from all points along one of the three axes, another pair of two of said modules are equally spaced from all points along another one of said three axes, and a further pair of two of said modules are equally spaced from all points along the last of said three axes;

each of said modules being of parallelipiped form;

said connector means defining corner recesses with the respective modules, and panels having corners received in said recesses.

51. An assembly as defined in claim 50 wherein said panels are sufficiently flexible as to be flexed into and out of said recesses.

52. A composite space frame structure fixed relative to three intersecting axes and to the origin defined by the point of intersection of such axes, said composite space frame structure comprising the combination of:

a plurality of space frame modules;

connector means for detachably connecting said modules in a fixed and spaced pattern relative to said origin and to said three axes such that all of the modules are equally spaced from said origin while one pair of two of said modules are equally spaced from all points along one of the three axes, another pair of two of said modules are equally spaced from all points along another one of said three axes, and a further pair of two of said modules are equally spaced from all points along the last of said three axes;

each of said modules being constructed of a plurality of struts and being collapsible from its space frame configuration to a bundle of generally parallel struts, each module including circumscribing pairs of struts disposed in crossed relation and pivot means for pivotally joining each such pair of struts in said crossed relation, each module further including strut means for self-locking said modules in expanded, space frame configuration, said strut means comprising a plurality of pairs of pivotally connected diagonal struts extending inwardly from and pivotally connected to said circumscribing pairs of struts, and face pivot means for pivotally connecting the ends of said circumscribing pairs of struts to each other and to ends of said diagonal struts; and said connector means joining adjacent face pivot means and defining a corner recess with each face pivot means, and at least one panel having its corners received in an array of said corner recesses.

53. An assembly as defined in claim 52 wherein said panel is sufficiently flexible as to be flexed into and out of its corner recesses.

54. A three dimensional structure for display or similar purposes which comprises;

a plurality of modules each of open space frame configuration and each presenting as first rectangular planar array of disc-like hubs on one side of the space frame configuration and a second rectangular planar array of disc-like hubs on the opposite side of the space frame configuration, the planar arrays being substantially parallel;

there being at least three modules arranged with a first module having its arrays disposed vertically, a second module having its arrays disposed with groups of hubs in the first array of the first module being in substantially touching relation with groups of hubs in the first array of the second module and with the first arrays of the first and second modules being perpendicular, and a third module having its arrays disposed horizontally with one hub of the first array of the third module being in substantially touching relation with one pair of hubs of said groups of hubs in the first arrays of the first and second modules and with at least one further hub of the first array of the third module being in substantially touching relation with another hub of said first array of the first module which is not one of said groups of hubs of said first array of the first of the first module;

connector means removably joining the hubs which are in substantially touching relation; and a compression strut having one end received in that connector means joining the three hubs of the three modules and its opposite end received in that connector means joining those hubs vertically spaced therefrom.

55. A three dimensional structure as defined in claim 54 including a compression sleeve substantially aligned above said compression strut and interposed between that hub of the first array of the third module which is in engagement with said connector means joining the three hubs of the three modules and that hub of the second array of the third module which is immediately above it.

56. A three dimensional structure for display or similar purposes which comprises:

a plurality of modules each of open space frame configuration and each presenting a first rectangular planar array of disc like hubs on one side of the space frame configuration and a second rectangular planar array of disc like hubs on the opposite side of the space frame configuration, the planar arrays being substantially parallel;

there being at least two modules arranged with a first module having its arrays disposed vertically, and a second module having its arrays disposed vertically with groups of hubs in the first array of the first module being in substantially touching relation with groups of hubs in the first array of the second module and with the first arrays of the first and second modules being perpendicular;

connector means removably joining hubs which are in substantially touching relation; and a vertical compression member having one end trapped between a hub of the first array of the first module and a member removably engaged therewith and its opposite end trapped between a hub of the first array of the first module and a member removably engaged therewith.

57. A connector for modular exhibits and the like, which comprises:

a disc like member having a cruciform rib configuration outstanding therefrom, and a split nose projecting from the juncture of said rib configuration.

58. A connector as defined in claim 57 including a second disc like member joined with the disc like member first mentioned and disposed at right angles thereto, said second disc like member having a cruciform rib configuration outstanding therefrom, and a split nose projecting from the juncture of the rib configuration last mentioned.

59. A connector as defined in claim 58 including a third disc like member joined with the other two disc like members in orthogonal relation thereto, said third disc like member having a cruciform rib configuration outstanding therefrom, and a split nose projecting from the juncture of the rib configuration last mentioned.

60. In a system of modular construction, the combination of:

a plurality of modules;

each module comprising a plurality of struts and pivot means joining said struts for manipulation between a collapsed condition in which the struts are generally parallel and in a bundle and an expanded condition in which the struts are contained within a rectilinear volume defined between opposite, parallel rectangular front and rear faces and bounded by rectangular side faces, said pivot means including pivot hubs which are situated in a first planar array at said front face defining at least one square and including pivot hubs at the corners of said front face and in a second planar array at said rear face and defining at least one square and including pivot hubs at the corners of said rear face;

said modules being grouped with the planar arrays of each module disposed at right angles to the planar arrays of any adjacent module and with one side edge of each module being disposed adjacent one side edge of an adjacent module so that pairs of hubs of adjacent modules are in perpendicular, substantially touching relation;

connector means for joining said hubs which are in perpendicular, substantially touching relation and said connector means defining corner recesses with the hubs with which they are in contact; and square panels having corner means received and held captive within said corner recesses.

61. In a modular construction as defined in claim 60 wherein said panels are sufficiently flexible as to be flexed into and out of said recesses.

62. In a modular system of construction, the combination of:

a plurality of modules, each module comprising a plurality of struts and pivot means for pivotally interconnecting said struts, each module being capable of manipulation between a collapsed condition in which the struts are generally parallel and in a bundle and an expanded condition in which the struts form an open space framework, some of said pivot means being in the form of disc-like hubs and said framework being such as to position a first plurality of said hubs in a planar array at one side of the framework and a second plurality of said hubs in a planar array at an opposite side of the framework;

said modules being positioned so that a group of said hubs at a side of one module is disposed adjacent a group of hubs at a side of another module;

connector means for detachably connecting pairs of adjacent hubs so as to join said one module to said another module and for defining a corner recess with an associated hub;

a panel having corner means received in said corner recesses for holding said panel against one of said modules; and rigidifying means for bracing said one module to resist deformation thereof.

63. In a modular system as defined in claim 62 wherein said panel is sufficiently flexible as to permit flexure thereof into and out of captured relation to said corner recesses.

64. In a modular system as defined in claim 63 wherein said rigidifying means extend vertically adjacent said panel.

65. In a modular system as defined in claim 64 including shelf means supported by said rigidifying means.

* * * * *

UNITED STATES PATENT AND TRADEMARK OFFICE

CERTIFICATE OF CORRECTION

PATENT NO. : 4,970,841

DATED : November 20, 1990

INVENTOR(S) : Theodore R. Zeigler

It is certified that error appears in the above-identified patent and that said Letters Patent is hereby corrected as shown below:

Col. 1, beginning at line 30 and ending at line 49 indent first sentence and right justify remainder of paragraph.

Col. 1, line 66 delete "Is" and insert thereto --is--.

Col. 2, line 15 delete "panes" and insert thereto --panels--.

Col. 3, line 2 delete "con-figuration" and insert thereto --configuration--.

Col. 4, line 4 delete "pan" and insert thereto --plan--.

Col. 5, line 61 delete "Is" and insert thereto --is--.

Col. 8, line 54 delete "pane" and insert thereto --panel--.

Col. 9, line 12 delete "the" and insert thereto --that--.

Col. 11, line 59 delete "Figure" and insert thereto --Figures--.

Col. 12, line 15 insert thereto --compression strut-- after the word "The".

Col. 12, line 21 insert thereto --prime-- after the numeral "231".

Col. 13, line 35 insert thereto --the-- after the word "to".

Col. 13, line 65 delete "provide" and insert thereto --provided--.

Col. 13, line 67 delete "," after the word "two".

Col. 14, line 3 delete "pane" and insert thereto --panel--.

Col. 14, line 30 delete "requIred" and insert thereto --required--.

Col. 16, line 24 delete "east" and insert thereto --least--.

UNITED STATES PATENT AND TRADEMARK OFFICE

CERTIFICATE OF CORRECTION

PATENT NO. : 4,970,841

DATED : November 20, 1990

INVENTOR(S) : Theodore R. Zeigler

It is certified that error appears in the above-identified patent and that said Letters Patent is hereby corrected as shown below:

Column 16, line 28, claim 14 insert --wherein-- after "claim 13".

Signed and Sealed this

First Day of September, 1992

*Attest:*

DOUGLAS B. COMER

*Attesting Officer*

*Acting Commissioner of Patents and Trademarks*